United States Patent [19]

Feeley

[11] Patent Number: 4,866,856

[45] Date of Patent: Sep. 19, 1989

[54] SOLIDS DEWATERING PROCESS AND APPARATUS

[75] Inventor: Brian P. Feeley, Hackettstown, N.J.

[73] Assignee: The Standard Oil Company, Cleveland, Ohio

[21] Appl. No.: 108,055

[22] Filed: Oct. 13, 1987

[51] Int. Cl.[4] ..... F26B 5/16

[52] U.S. Cl. ..... 34/9; 34/17; 34/15; 34/92

[58] Field of Search ..... 34/9, 15, 92, 17

[56] References Cited

U.S. PATENT DOCUMENTS

| | | | |
|---|---|---|---|
| 1,606,867 | 11/1926 | Broadbridge et al. . | |
| 1,685,654 | 9/1928 | Waggoner et al. . | |
| 1,905,072 | 4/1933 | Stuart . | |
| 1,905,073 | 4/1933 | Stuart . | |
| 1,912,697 | 6/1933 | Fife . | |
| 1,960,917 | 5/1934 | Nagelvoort | 44/6 |
| 2,098,232 | 11/1937 | Fife | 44/6 |
| 2,176,129 | 10/1939 | Fife | 44/6 |
| 2,431,891 | 12/1947 | Rosencranse . | |
| 3,323,591 | 6/1967 | Harvey . | |
| 3,327,402 | 6/1967 | Lamb et al. | 34/9 |
| 3,794,472 | 2/1974 | Macaluso et al | 44/6 |
| 3,903,012 | 9/1978 | Brandreth | 34/9 X |
| 3,961,914 | 6/1976 | Kindig et al. | 44/1 R |
| 3,985,516 | 10/1976 | Johnson et al. | 34/10 X |
| 3,985,517 | 10/1976 | Johnson | 34/10 X |
| 4,018,571 | 4/1977 | Cole et al. | 44/1 R |
| 4,057,399 | 11/1977 | Cole et al. | 44/6 |
| 4,161,450 | 7/1979 | Vitat et al. | 34/9 X |
| 4,212,112 | 7/1980 | LaDelfa et al. | 34/9 |
| 4,287,089 | 9/1961 | Convers et al. | 34/9 X |
| 4,322,219 | 3/1982 | Burns | 44/6 |
| 4,400,176 | 8/1983 | Kutta | 44/1 R |
| 4,422,246 | 12/1983 | Hardesty et al. | 34/9 X |
| 4,461,624 | 7/1984 | Wong | 34/9 X |
| 4,498,246 | 2/1985 | Cantu et al. | 34/9 |
| 4,504,274 | 3/1985 | Anderson | 34/9 X |
| 4,511,363 | 4/1985 | Nakamura et al. | 44/16 |
| 4,662,990 | 5/1987 | Bonanno | 34/9 X |
| 4,686,774 | 8/1987 | Hiraiwa et al | 34/9 |
| 4,763,423 | 8/1988 | Kemp, Jr. | 34/9 |

*Primary Examiner*—Henry A. Bennet

*Attorney, Agent, or Firm*—Michael F. Esposito; David T. Untener; Larry W. Evans

[57] ABSTRACT

A process and apparatus for dewatering water-containing mineral particles, e.g., pulverized coal and in particular, high moisture content, low rank coal, is described. In one embodiment, the process and apparatus make use of a hydrophobic dewatering aid to displace water chemically and/or interstitially bound to coal particles followed by stripping of the coal particles with a water-miscible solvent to facilitate drainage of such water from the coal particles.

20 Claims, 2 Drawing Sheets

13
14
11
10
12
20
21
15
22
21
23
17
18
16
19
26
VACUUM
25
24
WATER +
SOLVENT

SOLIDS DEWATERING PROCESS AND APPARATUS

BACKGROUND OF THE INVENTION

The present invention relates to a process and apparatus for removing water from water-containing solids and, more particularly, to a process and apparatus for dewatering carbonaceous solids such as coal having a relatively high moisture content, for example, low rank coal.

Known resources of coal and other solid carbonaceous fuel materials in the world are far greater than the known resources of petroleum and natural gas combined. Despite this enormous abundance of coal and related solid carbonaceous materials, reliance on these resources, particularly coal, as primary sources of energy, has been for the most part discouraged. The availability of cheaper, cleaner burning, more easily retrievable and transportable fuels such as petroleum and natural gas has in the past placed coal in a largely supporting role in the energy field.

As a result, efforts are being extended to make coal and related solid carbonaceous materials equivalent or better sources of energy than petroleum or natural gas. In the case of coal, for example, much of this effort is directed to overcoming the environmental problems associated with its production, transportation and combustion. For example, health and safety hazards associated with coal mining have been significantly reduced with the onset of new legislation governing coal mining.

Furthermore, numerous techniques have been explored and developed to make coal more suitable for burning and more readily transportable. Accordingly, more attention is being given to certain handling considerations such as pipeline transportation of coal, to both physical and chemical coal cleaning (beneficiation) processes and to aspects of these processes which can make coal and related carbonaceous material more attractive as fuel materials.

Attention has also been directed to reducing the water content of low rank coals in order to enhance their value as fuels. Since much of the water contained in low-rank coals is chemically bound thereto and/or is interstitially held within the coal particles, mere thermal drying of such coals at the comparatively low temperatures which are typical of many thermal drying operations fails to achieve a high enough level of water removal to make the coals competitive with low moisture content, high rank coals.

Several attempts have been made in the past to upgrade low-rank coal by a variety of dewatering techniques. For instance, U.S. Pat. No. 4,511,363 describes a method of upgrading low rank coals in which crushed low rank coal is dehydrated in a rotary drum in a drying section, the dehydrated coal is subjected to dry distillation in a distillation section and finally, the dry-distilled coal is cooled in a cooling section and permitted to absorb the tar which is produced during the distillation step.

U.S. Pat. No. 4,504,274 describes a process for enriching high moisture content low grade coals in a fluid bed by contact with heated char.

U.S. Pat. No. 4,400,176 describes a process for reducing the water content of coal containing bound water by maintaining the coal at a temperature of from 220°–500° F. in the presence of water at a pressure sufficient to maintain at least a portion of the water in the liquid phase for a time sufficient to release at least a portion of the bound water, this treatment being accompanied by contacting the coal with an acidic material selected from the group consisting of carboxylic organic acids containing up to about 6 carbon atoms, phenol, phenolic acids and inorganic acids.

Other processes for removing water from coals are disclosed, for example, in U.S. Pat. Nos. 4,461,624 (immersion of coal particles in residium at elevated temperature); 4,322,219 (contacting coal particles with polyethylene oxide of at least 200,000 molecular weight followed by evaporation of the water); 4,057,399 (treating coal particles with a hydrocarbon at elevated temperature and pressure sufficient to maintain a liquid system); 4,018,571 (heating a mixture of coal particles and water between 300° F. and the critical temperature of water at a pressure sufficient to maintain the water in the liquid state followed by cooling and separating the coal particles from the water by agglomeration with a hydrocarbon liquid); 3,985,516 and 3,985,517 (coating dried coal with a heavy hydrocarbon material to aid in the removal of moisture and prevent its reabsorption by the coal); 3,961,914 (coating coal particles with silicon dioxide resulting from the reaction of silicon tetrachloride vapor and water followed by increasing the temperature to drive off water vapor and hydrochloric acid); 3,327,402 (treating coal fines with organic solvents such as linear alkanols, acetone, methyl ethyl ketone, diethyl ketone and acetonitrile to remove water); and, 1,960,917 (coating coal particles with an aqueous oil emulsion and cause clinging water to drain away).

Some of the disadvantages associated with known processes of dewatering coal include their potential for environmental damage and/or high cost.

SUMMARY OF THE INVENTION

It is an object of the present invention to provide a process for dewatering water-containing solids, especially carbonaceous materials having a relatively high moisture content such as low rank coal.

It is a further object of the invention to provide an environmentally acceptable, economical process for removing substantial quantities of water which is chemically and/or interstitially bound to low rank coal.

Yet another object herein is to provide readily operated and conveniently maintainable apparatus for carrying out the foregoing dewatering process.

In accordance with the present invention, there is provided a process for dewatering water-containing solids which comprises:

(a) contacting the surfaces of water-containing solid particles provided as an aqueous slurry with a hydrophobic dewatering aid which displaces water originally associated with the particles; and, (b) stripping the thus treated particles with a water-miscible solvent which takes up water displaced from the particles by the dewatering aid thereby reducing the water content of the particles.

The apparatus for dewatering water-containing solids of the present invention comprises:

(a) means for contacting the surfaces of water-containing solid particles provided as an aqueous slurry with a hydrophobic dewatering aid which displaces water originally associated with the particles; and, (b) means for stripping the thus treated particles with a water-miscible solvent which takes up water displaced from the particles by the dewatering aid.

The foregoing process and apparatus are particularly well suited for the removal of surface water from coal, especially those coals which are high in moisture content such as the low rank coals. The process and apparatus are suitable for dewatering all types of coal including bituminous coal, sub-bituminous coal, anthracite, lignite, peat, etc., as well other solid carbonaceous materials such as coal from refuse piles, coal processing fines, carbonaceous fecal matter, and the like, both before and/or following any other coal treating operation(s) to which the coal particles may be subjected. The coal may be that present in a slurry incident a pulverization operation, a pipeline slurry, etc. The process and apparatus herein are especially advantageous for use in dewatering coal that has been subjected to flotation beneficiation as, for example, described in U.S. Pat. Nos. 4,304,573 and 4,412,843.

DESCRIPTION OF DRAWINGS

A fuller understanding of the nature and the objects of the invention will be had from the following detailed description taken in conjunction with the accompanying drawings in which.

DESCRIPTION OF THE PREFERRED EMBODIMENT

Figure 1:
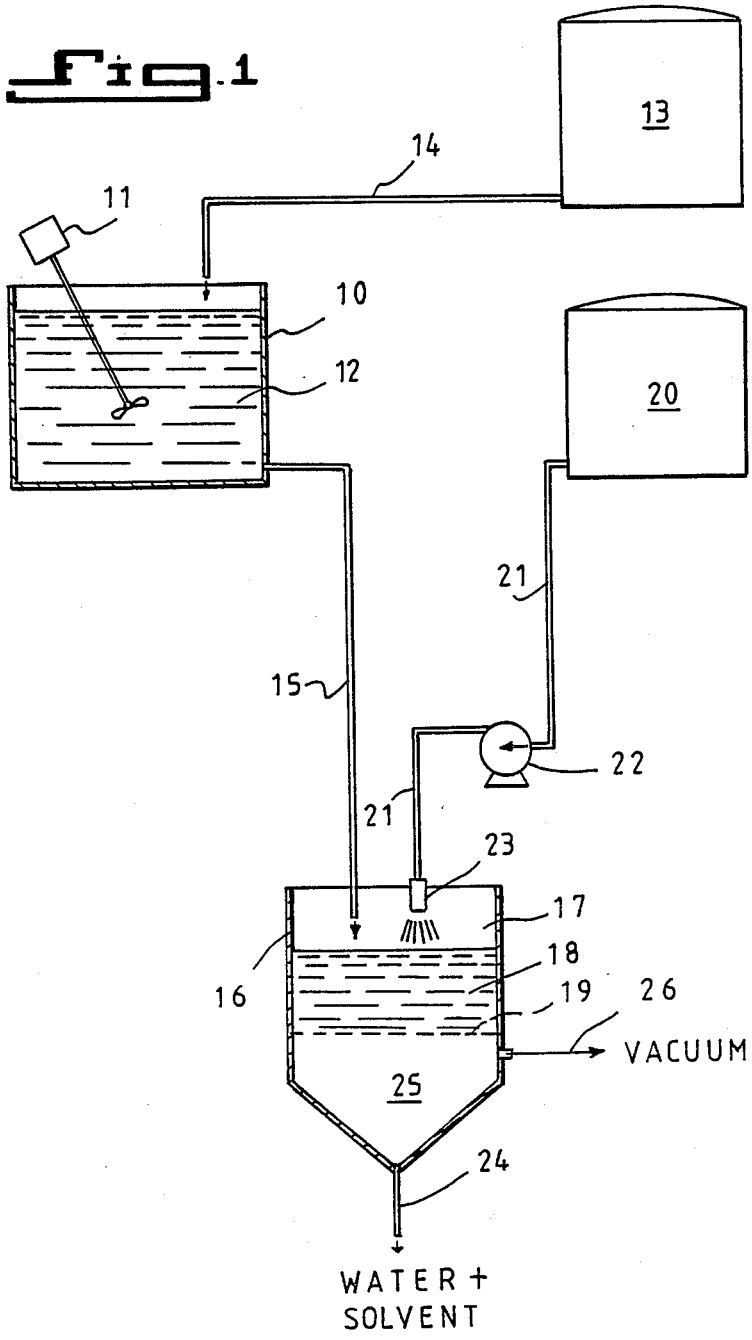
FIG. 1 is a schematic view of a dewatering process and apparatus in accordance with the present invention illustrating the dewatering of high moisture content, low rank coal; and, FIG. 2 is a schematic view of another process and apparatus in accordance with this invention for removing water from low rank coal.

Referring to FIG. 1, there is shown a tank or vessel 10 for holding a quantity of aqueous coal slurry 12 made up of from about 20 to about 50 weight percent low rank coal particles of about 20 to about 30 weight percent water content (based on wet coal) and reduced to 28 mesh size or finer. Vessel 10 is provided with a mechanical stirrer 11 or similar mixing device. In a given circumstance, it may be desirable to adjust the water level of the slurry to a particular level, for example, by addition of water through an auxiliary conduit (not shown).

Hydrophobic dewatering aid stored in vessel 13 is conveyed through conduit 14 to coal slurry 12 where it is admixed therewith by means of stirrer 11. In lieu of this arrangement, the dewatering agent can be sprayed onto coal particles as they cascade into vessel 10. Whatever the procedure used to contact the coal particles with dewatering aid, it is generally desirable to employ from about 0.1 to about 20 lb., and preferably from about 0.1 to about 5 lb., dewatering aid per ton of coal (dry basis).

Due to its hydrophobic nature, the dewatering agent is believed to adhere to the surfaces of the coal particles displacing water originally associated with the coal and making the water accessible to removal by the solvent treatment operation discussed below. Without wishing to be bound by any particular theory or explanation of how the dewatering aid functions, it has been speculated that dewatering occurs by reason of the coal having been rendered more hydrophobic although such result may also involve other phenomena such as a lowering of the surface tension of the water present in the coal, a breakup of coal floccules or still other mechanism(s).

The dewatering aids can be immiscible or miscible with water. If substantially immiscible (the preferred case), they can be appreciably more dense or less dense than water thus facilitating separation of excess dewatering aid from removed water and subsequent recycle. If miscible with water under the contacting conditions selected, any of a variety of known and conventional techniques can be utilized to achieve separation of excess dewatering aid and water, for example, chilling to effect phase separation followed by decanting, distillation, selective sorption, etc. Dewatering aids which can be used herein with generally good results include paraffin wax, paraffin liquid, paraffin extender, cotton seed oil, fuel oil, fatty acids, phenol, polyethylene and polypropylene glycols, polyfluorethylene, polyoxyethylene alcohols (liquid to waxy solids), polyoxyethylene fatty acid esters, animal fats, ethylene vinyl acetate, silicone, tall oil, duck wax, turtle wax, stearic acid, beeswax, blend of (nonionic) ethylene oxide and propylene glycol, modified reactive nitrogenous polymer such as Repel-O-Tex HM (Lyndal Chemical Co.), polyglycerol fatty acid ester, sodium diester sulfosuccinate, fatty imidazoline salt, alkyl polyoxyethylene glycol ether, phosphate ester of alkylaryl ethoxylate, sealer wax, e.g., an emulsifying gloss agent such as Sealer Wax CW-23 (Turtle Wax Inc.), butyl cellosolve, a water-displacing protective oil such as Oakite RB, Oakite HPO or Oakite Rinsite (Oakite Products Co.), an aqueous solution of an oxyalkylated alkyl alcohol and an aryl sulfonate such as Nalco Paver Dry 8814 (Nalco Chemical Co.), an oxyalkylate and fatty acids such as Nalco IDC-142 (Nalco Chemical Co.), polyethoxy-isopropoxy ethylene diamine such as Tetronics 1307 (BASF Wyandotte), isostearic acid, oleic acid, castor oil, 2-ethyl-1-hexanol, hydrolyzed polyacrylamide such as Separan (R) (Dow Chemical Co.) and dimethyldicoammonium chloride such as Armak (Akzona, Inc.) and any mixture of the foregoing.

Following intimate contact of the dewatering aid with the coal slurry, the latter is conveyed through conduit 15 to liquid drainage unit 16 which, in the embodiment shown, is provided as an enclosure or compartment 17 with the dewatering aid-coated coal slurry 18 supported upon a perforate screen or filter membrane 19 which retains the coal particles but permits passage of liquid and fines (if any) therethrough. A water miscible solvent is conveyed from storage vessel 20 through line 21 and forced under pressure by pump 22 through spray unit 23 upon coal slurry 18 where it strips water displaced from the coal by the dewatering aid. The type, amount and delivery (nozzle) pressure of the solvent can vary widely. In general, any low cost, industrial grade water miscible organic solvent is suitable for use in the stripping operation. Such solvents include lower aliphatic alcohols and their esters, e.g., methanol, ethanol, n-propanol, isopropanol, methyl acetate, ethyl acetate, ethyl propionate, ethyl butyrate. etc., ketones such as dimethyl ketone (acetone), methyl ethyl ketone, diethyl ketone, etc., nitriles such as acetonitrile, etc. The amount of solvent can in most cases vary from about 1.0 to about 50 lb., and preferably from about 1.0 to about 25 lb., per ton of coal (dry basis). Nozzle pressures of from about 5.0 to about 25 psig, and preferably from about 5.0 to about 16 psig, are generally effective. As the solvent contacts the coal slurry in compartment 17, it forms a solution with the water component of the slurry including water which had been removed from the coal particles by the displacement action of the dewatering aid referred to above. This aqueous solution is easily drained from the coal slurry by gravity through screen 19 where it is removed from drainage unit 16 through conduit 24. Drainage can be assisted and accelerated by means of a vacuum applied to chamber 25 through line 26. A vacuum of from 5 to about 35 in. Hg, and preferably of from about 5 to about 20 in. Hg, is generally advantageous for this purpose. Drainage can be effected in other ways, e.g., by a rotary drum filter, centrifuge, etc., as is known in the art.

Figure 2:
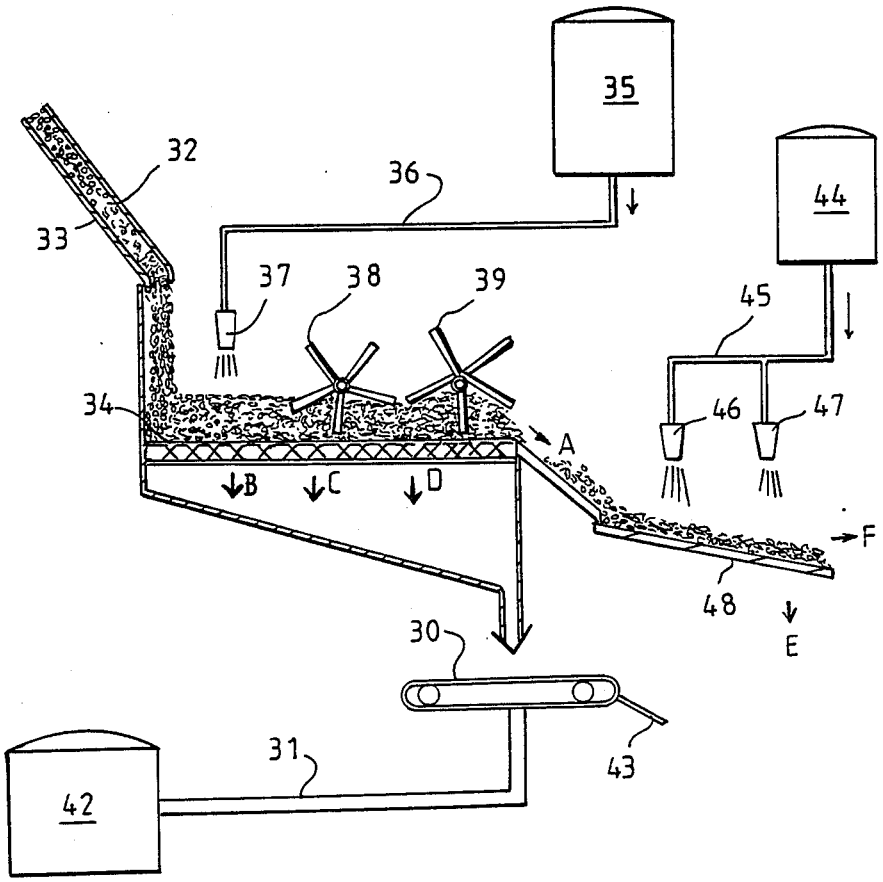

In another embodiment of the invention shown in FIG. 2, low rank coal particles 32 of about the same moisture content and size as those treated in the dewatering process of FIG. 1, without or with additional water to form a slurry, cascade from chute 33 onto a supported perforate stationary screen or membrane 34. The coal particles are coated with hydrophobic dewatering aid conveyed from storage vessel 35 through conduit 36 upon the coal particles by spray nozzle 37. Paddles 38 and 39 convey the coated coal particles along the upper surface of screen 34 while excess dewatering aid, water and fines, if any, pass therethrough under the influence of gravity, with or without vacuum assist, as generally indicated by arrows B, C and D. Alternatively, the paddles (or similar devices) can be dispensed with in favor of a continuously moving screen, for example, as depicted by element 30, the net effect of which is to provide drainage of excess dewatering aid just as in the stationary screen embodiment shown. The excess dewatering aid freely passes through perforate endless screen belt 20 and is conveyed through conduit 31 to storage vessel 42 from which it can be recycled to process. Any fines falling upon belt 30 can be readily removed therefrom, e.g., by scraper, 43.

In an optional treatment operation, the drained, dewatered coal particles are subjected to further dewatering by treatment with a water miscible solvent much as in the embodiment described in connection with FIG. 1. In this optional treatment, organic solvent is transferred from storage vessel 44 through conduit 45 and discharged under pressure through one or more spray nozzles 46 and 47 upon drained, partially dewatered coal advancing in the general direction of arrow A onto perforate slide or conveyor 48, the resulting solvent-water solution draining therefrom as generally indicated by arrow E. Dewatered coal is thereafter conveyed to storage in the direction of arrow F. If desired, the dewatered coal can be vacuum-filtered as in FIG. 1 or centrifuged to enhance drainage of residual water.

While preferred embodiments and several variations of the present invention are described in detail herein, it should be apparent that the disclosure and teachings of the present invention will suggest many alternative designs to those skilled in the art.

What is claimed is:

1. A process for dewatering water-containing solids which comprises:

(a) contacting the surfaces of water-containing solid particles provided as an aqueous slurry with a hydrophobic dewatering aid which displaces water originally associated with the particles; and, (b) stripping the thus treated particles with a water-miscible solvent which takes up water displaced from the particles by the dewatering aid thereby reducing the water content of the particles.

2. The process of claim 1 wherein the particles are carbonaceous particles.

3. The process of claim 2 wherein the particles are high moisture content, low rank coal particles.

4. The process of claim 1 wherein the dewatering aid is selected from the group consisting of paraffin wax, paraffin liquid, paraffin extender, cotton seed oil, fuel oil, fatty acids, phenol, polyethylene glycol, polypropylene glycol, polyfluorethylene, liquid to waxy polyoxyethylene alcohol, polyoxyethylene fatty acid ester, animal fat, ethylene vinyl acetate, silicone, tall oil, duck wax, turtle wax, stearic acid, beeswax, blend of nonionic ethylene oxide and propylene glycol, modified reactive nitrogenous polymer, polyglycerol fatty acid ester, sodium diester sulfosuccinate, fatty imidazoline salt, alkyl polyoxyethylene glycol ether, phosphate ester of alkylaryl ethoxylate, sealer wax, butyl cellosolve, protective oil, oxyalkylated alkyl alcohol, aryl sulfonate, oxyalkylate, fatty acids, polyethoxy-isopropoxy ethylene diamine, isostearic acid, oleic acid, castor oil, 2-ethyl-1-hexanol, hydrolyzed polyacrylamide, dimethyldicoammonium chloride and any mixture of the foregoing.

5. The process of claim 1 wherein the water-miscible solvent is selected from the group consisting of lower aliphatic alcohol and/or ester thereof, ketone and nitrile.

6. The process of claim 1 wherein stripping is carried out under vacuum.

7. A process for dewatering water-containing solids which comprises:

(a) contacting the surfaces of water-containing solid particles in a first zone with a hydrophobic dewatering aid which displaces water originally associated with the particles; and, (b) transferring the particles from said first zone to a second zone to effect drainage of excess dewatering aid from the particles; and (c) transferring the particles from said second zone to a third zone to effect stripping of water associated with the particles with a water-miscible solvent.

8. The process of claim 7 wherein the particles are carbonaceous particles.

9. The process of claim 8 wherein the particles are high moisture content low rank coal particles.

10. The process of claim 7 wherein the dewatering aid is selected from the group consisting of paraffin wax, paraffin liquid, paraffin extender, cotton seed oil, fuel oil, fatty acids, phenol, polyethylene glycol, polypropylene glycol, polyfluorethylene, liquid to waxy polyoxyethylene alcohol, polyoxyethylene fatty acid ester, animal fat, ethylene vinyl acetate, silicone, tall oil, duck wax, turtle wax, stearic acid, beeswax, blend of nonionic ethylene oxide and propylene glycol, modified reactive nitrogenous polymer, polyglycerol fatty acid ester, sodium diester sulfosuccinate, fatty imidazoline salt, alkyl polyoxyethylene glycol ether, phosphate ester of alkylaryl ethoxylate, sealer wax, butyl cellosolve, protective oil, oxyalkylated alkyl alcohol, aryl sulfonate, oxyalkylate, fatty acids, polyethoxy-isopropoxy ethylene diamine, isostearic acid, oleic acid, castor oil, 2-ethyl-1-hexanol, hydrolyzed polyacrylamide, dimethyldicoammonium chloride and any mixture of the foregoing.

11. The process of claim 7 wherein the particles are carbonaceous particles.

12. The process of claim 11 wherein the particles are high moisture content low rank coal particles.

13. The process of claim 7 wherein the dewatering aid is selected from the group consisting of paraffin wax, paraffin liquid, paraffin extender, cotton seed oil, fuel oil, fatty acids, phenol, polyethylene glycol, polypropylene glycol, polyfluorethylene, liquid to waxy polyoxyethylene alcohol, polyoxyethylene fatty acid ester, animal fat, ethylene vinyl acetate, silicone, tall oil, duck wax, turtle wax, stearic acid, beeswax, blend of nonionic ethylene oxide and propylene glycol, modified reactive nitrogenous polymer, polyglycerol fatty acid ester, sodium diester sulfosuccinate, fatty imidazoline salt, alkyl polyoxyethylene glycol ether, phosphate ester of alkylaryl ethoxylate, sealer wax, butyl cellosolve, protective oil, oxyalkylated alkyl alcohol, aryl sulfonate, oxyalkylate, fatty acids, polyethoxy-isopropoxy ethylene diamine, isostearic acid, oleic acid, castor oil, 2-ethyl-1-hexanol, hydrolyzed polyacrylamide, dimethyldicoammonium chloride and any mixture of the foregoing.

14. The process of claim 7 wherein the water miscible solvent is selected from the group consisting of lower aliphatic alcohol and/or ester, thereof, ketone and nitrile.

15. Apparatus for dewatering water-containing solids which comprises:

(a) means for contacting the surfaces of water-containing solid particles provided as an aqueous slurry with a hydrophobic dewatering aid which displaces water originally associated with the particles; and, (b) means for stripping the thus treated particles with a water-miscible solvent which takes up water displaced from the particles by the dewatering aid.

16. The apparatus of claim 15 wherein stripping means (b) is associated with vacuum means.

17. Apparatus for dewatering water containing solids which comprises:

(a) means for contacting the surfaces of water containing solid particles in a first zone with a hydrophobic dewatering aid which displaces water originally associated with the particles;

(b) means for transferring the particles from said first zone to a second zone to effect drainage of excess dewatering aid from the particles, wherein said means (b) comprises:

(i) a stationary perforate screen extending from said first zone to said second zone for supporting particles upon its upper surface; and, (ii) means for conveying particles from said first zone to said second zone.

18. The apparatus of claim 17 which further comprises:

(c) means for transferring the particles from said second zone to a third zone to effect stripping of water associated with the particles with a water-miscible solvent.

19. Apparatus for dewatering water-containing solids which comprises:

(a) means for contacting the surfaces of water containing solid particles in a first zone with a hydrophobic dewatering aid which displaces water originally associated with the particles; and (b) means for transferring the particles from said first zone to a second zone to effect drainage of excess dewatering aid from the particles, wherein means (b) comprises a moving perforate screen.

20. The apparatus of claim 19 which further comprises:

(c) means for transferring the particles from said second zone to a third zone to effect stripping of water associated with the particles with a water-miscible solvent.

* * * * *